US011353815B2

(12) United States Patent
Monde et al.

(10) Patent No.: US 11,353,815 B2
(45) Date of Patent: Jun. 7, 2022

(54) RECORDING MATERIAL DETERMINATION DEVICE THAT DETERMINES TYPE OF RECORDING MATERIAL, AND IMAGE FORMING APPARATUS

(71) Applicant: CANON KABUSHIKI KAISHA, Tokyo (JP)

(72) Inventors: Masafumi Monde, Kanagawa (JP); Hiromitsu Kumada, Shizuoka (JP); Yuka Fujii, Kanagawa (JP); Mizuki Ishimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/339,134

(22) Filed: Jun. 4, 2021

(65) Prior Publication Data

US 2021/0405566 A1 Dec. 30, 2021

(30) Foreign Application Priority Data

Jun. 25, 2020 (JP) ..... JP2020-109835

(51) Int. Cl.
*G03G 15/00* (2006.01)

(52) U.S. Cl.
CPC ..... *G03G 15/5029* (2013.01)

(58) Field of Classification Search
CPC ..... G03G 15/5029; G03G 2215/00637; G03G 2215/00751
See application file for complete search history.

(56) References Cited

U.S. PATENT DOCUMENTS 9,134,672 B2 * 9/2015 Iwasa ..... G03G 15/5029

FOREIGN PATENT DOCUMENTS

| | | | |
|---|---|---|---|
| JP | 2004107030 | A | 4/2004 |
| JP | 2005024428 | A | 1/2005 |
| JP | 2009173359 | A | 8/2009 |
| WO | 2011074061 | A1 | 6/2011 |

* cited by examiner

*Primary Examiner* — Susan S Lee
(74) *Attorney, Agent, or Firm* — Canon U.S.A., Inc. I.P. Division

(57) ABSTRACT

A recording material determination device includes a transmission unit, a drive unit, a reception unit, and a control unit. The drive unit outputs a drive signal for transmitting an ultrasonic wave from the transmission unit to the reception unit. The control unit determines a type of a recording material, based on a first value of the ultrasonic wave through the recording material received by the reception unit in a first mode for outputting a first number of drive signals from the drive unit in a first period, and a second value of the ultrasonic wave through the recording material received by the reception unit in a second mode for outputting a second number of drive signals from the drive unit in a second period. The second number of drive signals is greater than the first number of drive signals.

15 Claims, 11 Drawing Sheets

RECORDING MATERIAL DETERMINATION DEVICE THAT DETERMINES TYPE OF RECORDING MATERIAL, AND IMAGE FORMING APPARATUS

BACKGROUND

Field

The present disclosure relates to a recording material determination device using an ultrasonic wave.

Description of the Related Art

Conventionally, there are various types of image forming apparatus for forming an image based on an image signal, such as an electrophotographic type and an inkjet type. There are various types of recording materials on which images are to be formed in such image forming apparatuses, and the recording materials have various characteristics in terms of size, basis weight, surface property, etc. To perform image formation suitable for these recording materials, one type of image forming apparatus includes a sensor for determining the type of a recording material. For example, Japanese Patent Application Laid-Open No. 2004-107030 discusses a method of transmitting an ultrasonic wave to a recording material and receiving the ultrasonic wave through the recording material, thereby detecting the basis weight of the recording material and determining the type of the recording material based on the detected basis weight.

However, the basis weight of the recording material is not uniform in the entire area of the recording material. Because of the influence of this nonuniformity, the accuracy of detecting the recording material can decrease depending on the position at which the recording material is detected.

SUMMARY

According to an aspect of the present disclosure, a recording material determination device includes a transmission unit configured to transmit an ultrasonic wave, a drive unit configured to output a drive signal for transmitting the ultrasonic wave from the transmission unit, a reception unit configured to receive the ultrasonic wave, and a control unit configured to determine a type of a recording material, wherein the control unit determines the type of the recording material, based on a first value of the ultrasonic wave through the recording material received by the reception unit in a first mode for outputting a first number of drive signals from the drive unit in a first period, and a second value of the ultrasonic wave through the recording material received by the reception unit in a second mode for outputting a second number of drive signals from the drive unit in a second period, and wherein the second number of drive signals is greater than the first number of drive signals.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. The following exemplary embodiments are not intended to limit the present disclosure according to the scope of claims, and not all of combinations of features described in the exemplary embodiments are necessarily required for a solution of the present disclosure.

Image Forming Apparatus

Figure 1:
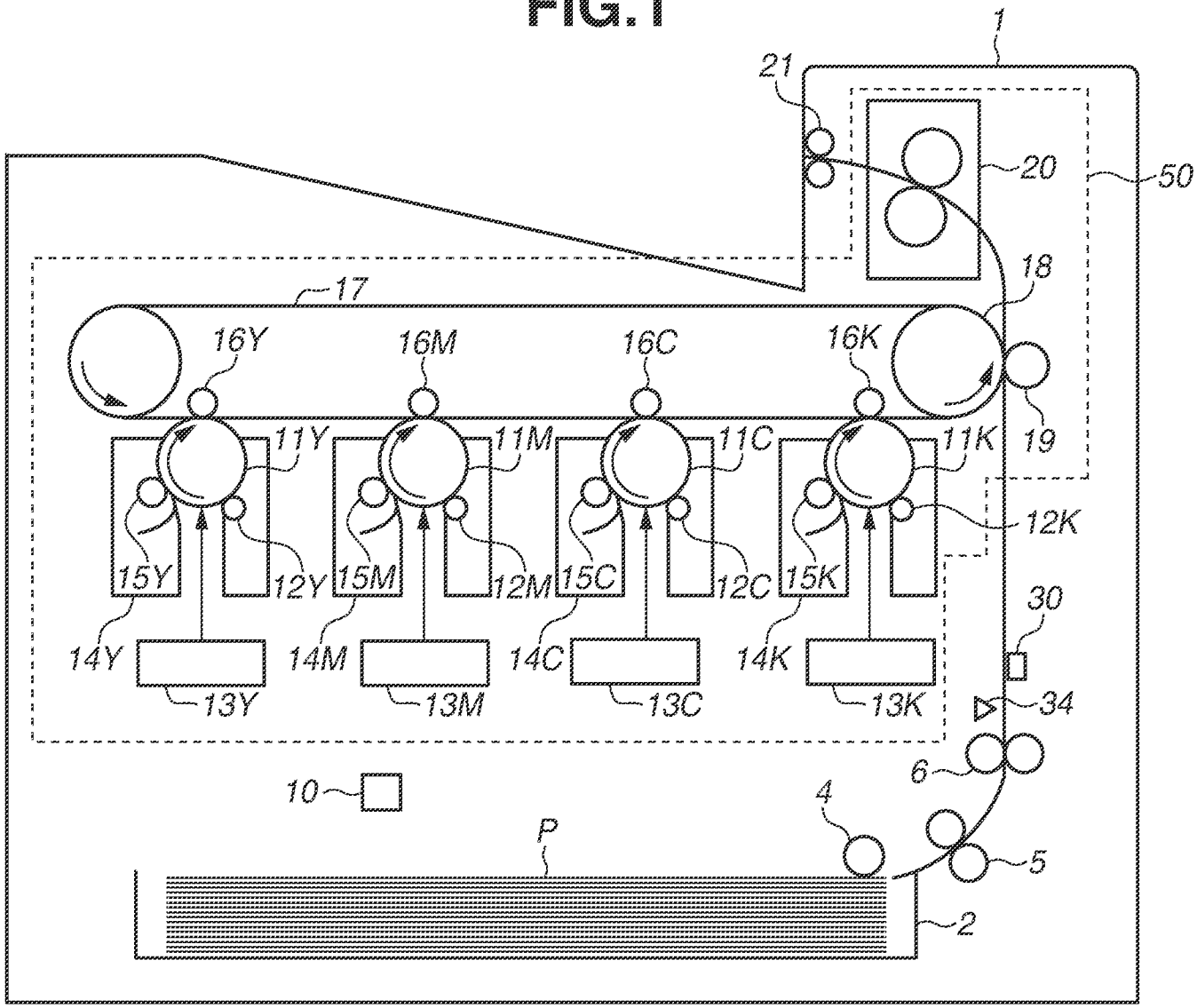
FIG. 1 is a schematic structural diagram illustrating an image forming apparatus.

FIG. 1 is a schematic structural diagram illustrating an image forming apparatus 1 according to a first exemplary embodiment. The image forming apparatus 1 is an electrophotographic full color printer employing an intermediate transfer system. The image forming apparatus 1 includes four image forming stations that form images of colors of yellow, magenta, cyan, and black. These four image forming stations are arranged in a line at even intervals. In the following description, English characters Y, M, C, and K at the ends of the reference numerals indicate that members represented by the respective reference numerals are related to the formation of toner images of yellow (Y), magenta (M), cyan (C), and black (K). In the following description, in a case where it is not necessary to distinguish between the colors, the reference numerals excluding the English characters Y, M, C, and K at the ends thereof can be used.

The image forming apparatus 1 is configured to form a color image by overlapping toners, i.e., developers, of four colors of yellow (Y), magenta (M), cyan (C), and black (K). A sheet feeding cassette 2 stores a recording material P that is, for example, paper. The recording material P stored in the sheet feeding cassette 2 is fed by a sheet feeding roller 4. The recording material P fed by the sheet feeding roller 4 is conveyed by a conveyance roller pair 5 and a registration roller pair 6. A registration sensor 34 for detecting the presence or absence of the recording material P is near the registration roller pair 6.

A photosensitive drum 11 serving as a photosensitive member has a photosensitive layer on a drum-shaped aluminum base, and is rotated by a driving device (not illustrated) at a predetermined process speed in a direction indicated by an arrow in FIG. 1. The process speed here corresponds to a circumferential velocity (a surficial moving speed) of the photosensitive drum 11. A charging roller 12 charges the photosensitive drum 11 uniformly to a predetermined potential. A laser scanner 13 emits a laser beam corresponding to image information to expose the surface of the photosensitive drum 11. An electrostatic latent image corresponding to the image information is thereby formed on the surface of the photosensitive drum 11.

A process cartridge 14 includes a development roller 15, and develops the electrostatic latent image formed on the photosensitive drum 11 with the development roller 15 using the toner stored in the process cartridge 14. A primary transfer roller 16 primarily transfers the image formed on the photosensitive drum 11 onto an intermediate transfer belt 17. The intermediate transfer belt 17 is driven by a drive roller 18.

A secondary transfer roller 19 secondarily transfers the primarily-transferred image on the intermediate transfer belt 17 onto the recording material P. A fixing device 20 fixes the secondarily-transferred image on the recording material P by heating and pressing. The above-described configuration related to image formation, including the photosensitive drum 11 to the fixing device 20, is an example of an image forming unit 50. A discharge roller 21 discharges the recording material P subjected to fixing by the fixing device 20 to a sheet discharge tray.

A recording material determination device 30 serving as a detection unit detects the basis weight of the recording material P. There will be described below a method of determining the recording material P and a method of controlling an image forming condition (a secondary transfer condition or a fixing condition), based on the basis weight of the recording material P. Typically, the resistance value of the recording material P varies depending on the basis weight of the recording material P, and thus it may be desirable to change the secondary transfer condition of application of a secondary transfer bias for the secondary transfer of the toner, or the like, based on the basis weight. The heat capacity of the recording material P also varies depending on the basis weight of the recording material P, and thus it may be desirable to change the fixing condition such as a fixing temperature, a fixing time period, or a conveyance speed for conveying the recording material P for fixing the toner, based on the basis weight.

Further, the basis weight of the recording material P is not uniform on the entire surface, and, typically, such nonuniformity is characterized by a mixture of nonuniformity of cycles of several hundred micrometers to several millimeters. Therefore, the characteristic of the nonuniformity varies depending on the type of the recording material P (paper type). The recording material P having large basis-weight nonuniformity on the entire surface of the recording material P has an area with large heat capacity as compared with the recording material P having small basis-weight nonuniformity, even if these recording materials P are the same in terms of the mean value of basis weight per sheet of the recording material P. Therefore, to fix the toner to the recording material P having large basis-weight nonuniformity, it may be desirable to set a fixing temperature higher than that for the recording material P having small basis-weight nonuniformity. In this way, an appropriate image forming condition is set based on the difference in the characteristic of the basis weight of the recording material P, so that optimum image formation can be performed.

A control unit 10 includes a micro processing unit (MPU) including a central processing unit (CPU), a random access memory (RAM) to be used for calculation and temporary storage of data for controlling the image forming apparatus 1, and a storage unit such as a read only memory (ROM) that stores a program for controlling the image forming apparatus 1 and various data. The control unit 10 determines the type of the recording material P, based on the value of the basis weight detected by the recording material determination device 30. Further, the control unit 10 determines the image forming condition corresponding to the type of the recording material P, and controls the image forming apparatus 1 to operate based on the image forming condition corresponding to the recording material P.

Recording Material Determination Device

Figure 2:
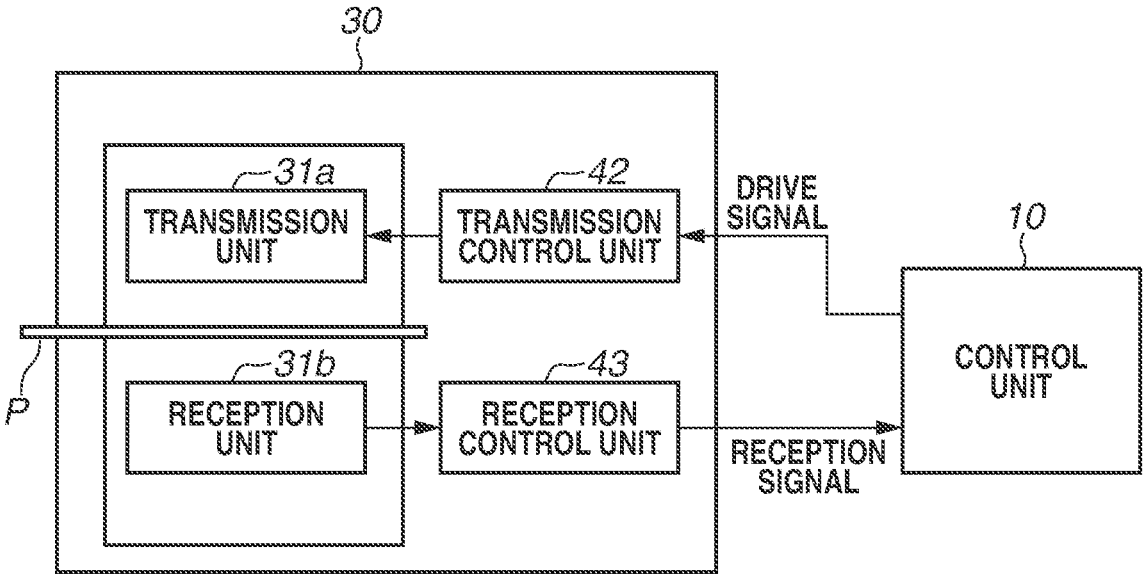
FIG. 2 is a block diagram illustrating a recording material determination device.

FIG. 2 is a block diagram illustrating the recording material determination device 30. The recording material determination device 30 includes a transmission control unit 42, a reception control unit 43, a transmission unit 31*a* that transmits an ultrasonic wave, and a reception unit 31*b* that receives the ultrasonic wave. The transmission unit 31*a* is an element capable of transmitting a sound wave of a frequency of 40 kHz in response to an input arbitrary signal. The reception unit 31*b* is an element capable of receiving the sound wave transmitted from the transmission unit 31*a*, and outputs a signal corresponding to the sound pressure of the received sound wave. The frequency of the sound wave is 40 kHz in the present exemplary embodiment, but can be set based on the specified element if the frequency enables the detection of the characteristic value of the basis weight of the recording material P. The transmission unit 31*a* and the reception unit 31*b* are each disposed near a conveyance path for conveying the recording material P, so that the sound wave through the recording material P can be received.

The transmission control unit 42 is a circuit unit having a function of amplifying a drive signal from the control unit 10 and driving the transmission unit 31*a* based on the amplified drive signal. The reception control unit 43 is a circuit unit having a function of amplifying and half-wave rectifying the signal from the reception unit 31*b*, thereby generating a reception signal. The reception signal generated by the reception control unit 43 is input to an analog-to-digital (AD) port of the control unit 10, and the control unit 10 detects the waveform of the reception signal based on the converted digital value, and extracts the peak value thereof as a reception level.

Detection of Mean Value of Basis Weight

Figure 3:
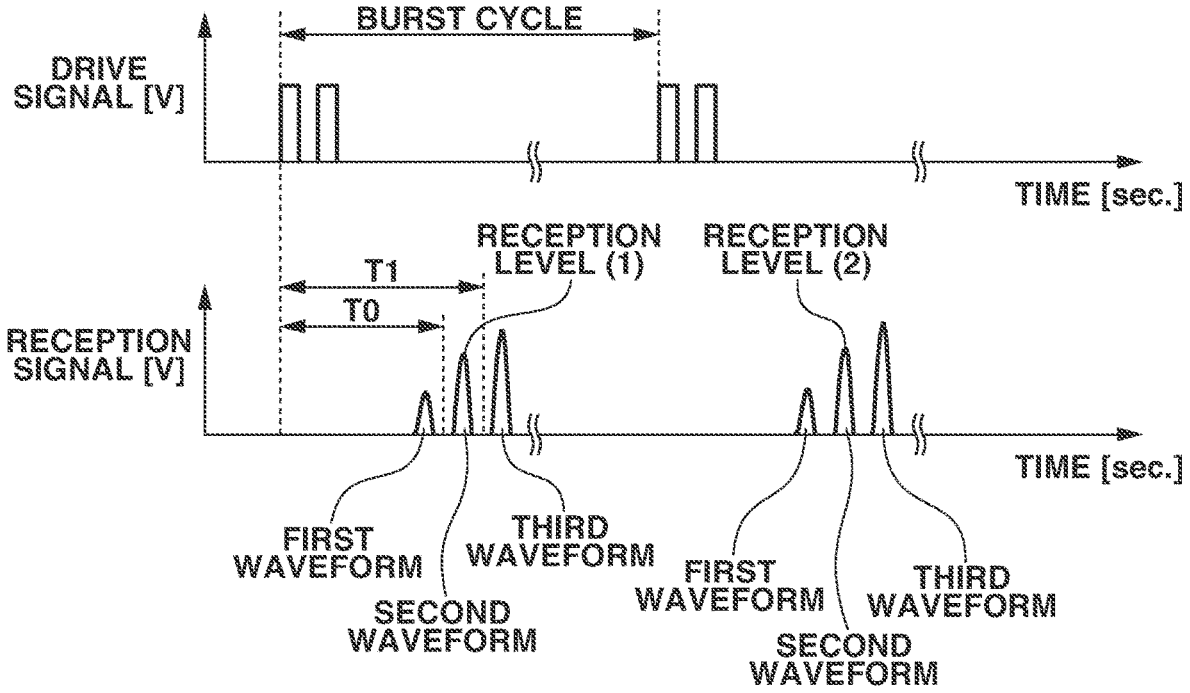
FIG. 3 is a diagram illustrating a drive signal and a reception signal of an ultrasonic wave in a case where the mean value of basis weight is detected.

FIG. 3 is a diagram illustrating the drive signal and the reception signal of the ultrasonic wave in a case where the mean value of basis weight is detected. A summary of operation for calculating the mean value of the basis weight of the recording material P, serving as a first mode, will be described with reference to FIG. 3. The drive signal is a periodic pulse wave (hereinafter may also be referred to as the burst wave) with a frequency of 40 kHz, a pulse number of 2, and a burst cycle of 10 msec. In other words, it can be said that the drive signal of a first number (2 pulses) is transmitted in a predetermined period (10 msec). Intermittent driving of alternately having a period for outputting the drive signal and a period for not outputting the drive signal is performed.

The waveform of the reception signal generated by the reception control unit 43 has a peak value for every half wave of 40 kHz equal to the frequency of the sound wave of the transmission unit 31*a*, based on the sound pressure of the sound wave received by the reception unit 31*b*. Further, although the pulse number of the drive signal is 2, the waveform of the reception level has two or more peaks. This because the reverberation of the transmission unit 31*a* or the reception unit 31*b* is present.

The control unit 10 detects the second waveform of the reception signal and extracts the peak value thereof as the reception level. The second waveform is detected by detecting the reception level in a time period between a predetermined time T0 and a predetermined time T1, which is a time period between arbitrary predetermined times synchronized with the drive signal. Here, the predetermined times T0 and T1 are calculated beforehand from the relationship between the distance between the transmission unit 31*a* and the reception unit 31*b*, and the sound speed of the ultrasonic wave, and set. The control unit 10 transmits the drive signal to the transmission control unit 42 in a period in which the recording material P is conveyed between the transmission unit 31*a* and the reception unit 31*b*. Subsequently, a reception level (1), a reception level (2), . . . , and a reception level (n) of the received ultrasonic wave through the recording material P while the recording material P is conveyed are sequentially extracted. These reception levels can also be referred to as the first value.

The control unit 10 calculates the mean value of the extracted plurality of reception levels, and calculates the mean value of the basis weight of the recording material P by using a conversion table (not illustrated) for conversion between the reception level and the basis weight in the storage unit of the control unit 10 or a calculation formula (not illustrated). Here, in the present exemplary embodiment, the pulse number of the drive signal is 2 and the waveform for detecting the peak value of the reception level is the second waveform, but these are not limited thereto. For example, the first waveform may be used or both of the first wave and the second wave may be used, if the waveform of the primary wave less affected by a disturbance caused by the recording material P or a neighboring member can be detected for the pulse number of the drive signal, based on the magnitude of the reception signal. Further, the burst cycle is 10 msec, but is not limited thereto. The burst cycle may be set to a time period longer than or equal to a time period in which the reverberation of the transmission unit 31*a* and the reception unit 31*b* sufficiently subsides, if the accuracy of detecting the basis weight can be sufficient. Furthermore, the extraction of the reception level uses the peak value of the receiving wave form, but is not limited thereto. For example, a characteristic value that can determine the level of the reception signal, such as the effective value or the mean value, may be used.

Figure 4:
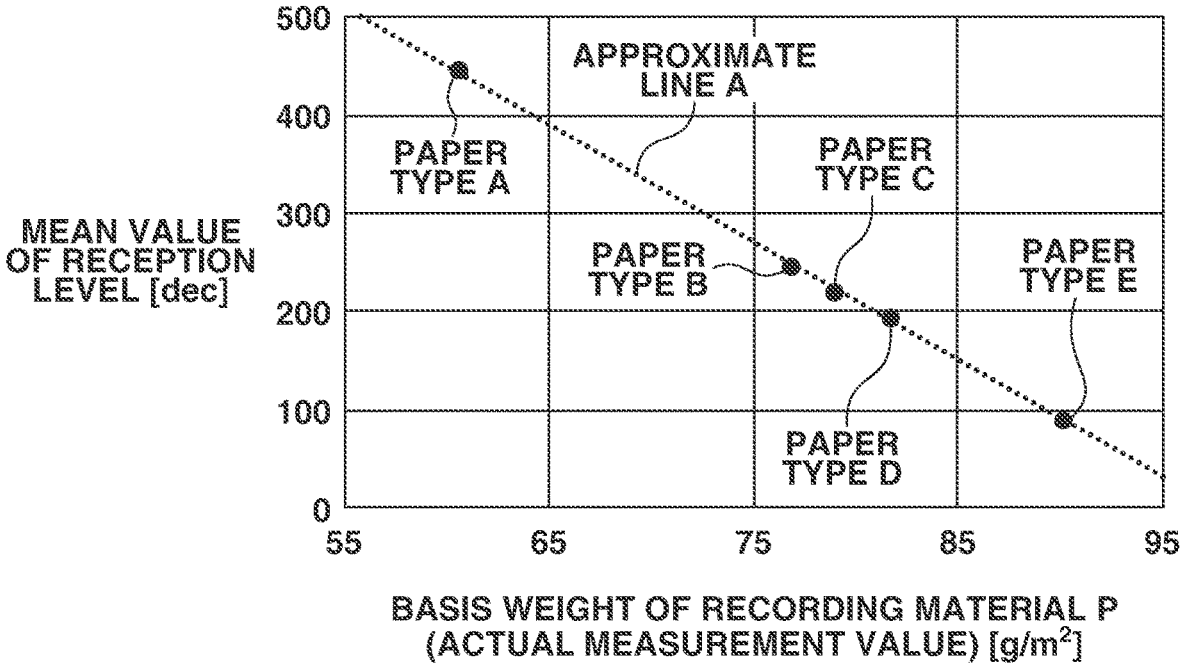
FIG. 4 is a graph illustrating the relationship between the actual measurement value of the basis weight of a recording material P and the mean value of reception level.

FIG. 4 is a graph illustrating the relationship between the actual measurement value of the basis weight of the recording material P and the mean value of the reception level. Recording materials of a paper type A, a paper type B, a paper type C, a paper type D, and a paper type E varying in basis weight are measured as samples. The actual measurement value of the basis weight is measured with an electronic scale and calculated, and the mean value of the reception level is calculated by the detection method in the present exemplary embodiment. As illustrated in FIG. 4, the reception level decreases as the basis weight of the recording material P increases. This is because the sound pressure of the ultrasonic wave passing through the recording material P attenuates as the basis weight of the recording material P increases. The control unit 10 can calculate the mean value of the basis weight of the recording material P from the obtained mean value of the reception level, using the equation of an approximate line A illustrated in FIG. 4.

Detection of Basis-Weight Nonuniformity

Figure 5:
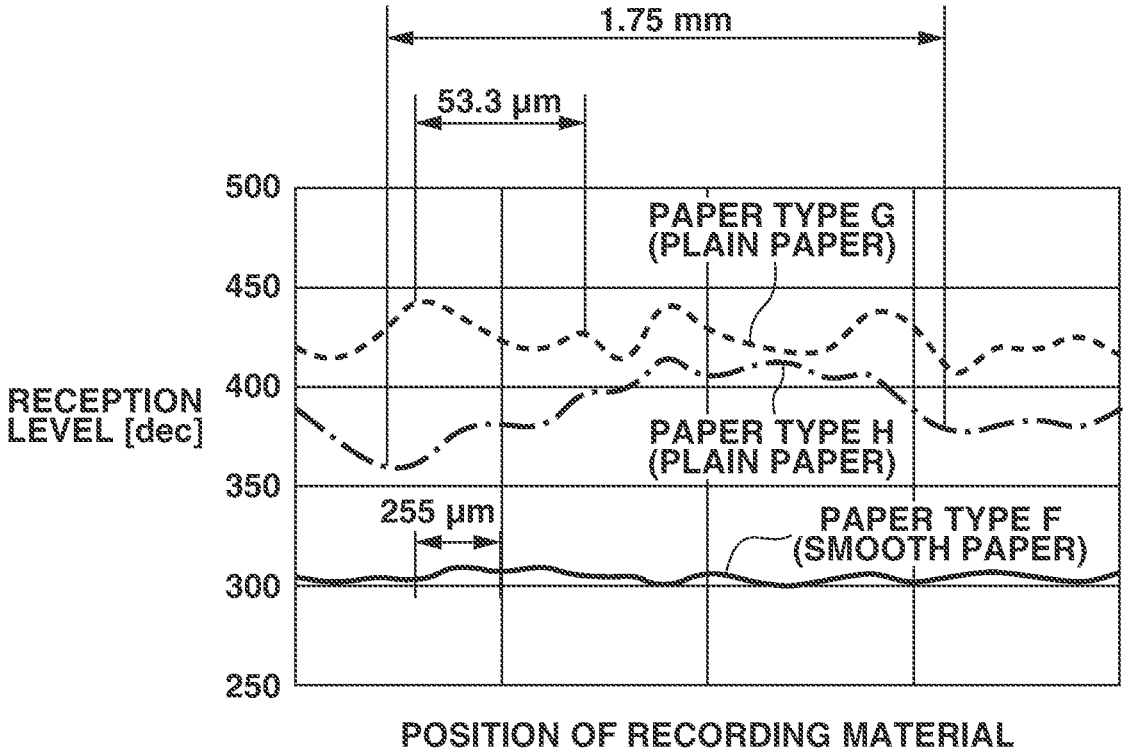
FIG. 5 is a graph illustrating basis-weight nonuniformity of a paper type F, a paper type G, and a paper type H.

As described above, there are various types of recording material P to be used for image formation, such as smooth paper, plain paper, bond paper, thick paper, and gloss paper, and the accuracy of the paper type determination can be improved by detecting not only the mean value of the basis weight but also the nonuniformity of the basis weight. FIG. 5 is a graph illustrating the basis-weight nonuniformity of arbitrary paper types F, G, and H. The horizontal axis indicates the position of the recording material P, and the vertical axis indicates the reception signal in detecting the basis weight. As illustrated in FIG. 5, the basis-weight nonuniformity varies depending on the type of the recording material P, and has a cycle from several hundred micrometers to several millimeters. Therefore, it is desirable to set the resolving power of the recording material P for the detection of the basis-weight nonuniformity, to a value less than several hundred micrometers.

If the basis-weight nonuniformity is detected using the above-described method of detecting the basis weight from the plurality of reception levels using the burst wave, the resolving power can be insufficient. The resolving power is determined by the burst cycle of the drive signal and the conveyance speed for the recording material P. For example, in a case where the conveyance speed for the recording material P is 80 mm/sec and the burst cycle is 10 msec, the minimum resolving power for detecting the basis weight is 0.8 mm. Further, for example, in a case where the conveyance speed for the recording material P is increased and set to 300 mm/sec to enhance the productivity, and the burst cycle is 10 msec, the minimum resolving power for detecting the basis weight is 3 mm, leading to a large decrease in the resolving power. Further, to detect the reception level of the primary wave of the ultrasonic wave directly arriving at the reception unit 31*b*, it may be desirable to set the burst cycle to a length more than or equal to the length of the time to wait until the reverberation of the transmission unit 31*a* or the reception unit 31*b* subsides. Usually, it is desirable to ensure that the burst cycle is a few milliseconds or more. Therefore, there is a limit to the extent of increasing the resolving power by reducing the burst cycle. In this way, there is a case where sufficient resolving power cannot be obtained, depending on the condition of, for example, the conveyance speed for the recording material P or the burst cycle.

Therefore, in the present exemplary embodiment, the basis-weight nonuniformity is detected by ensuring sufficient resolving power by using the continuous pulse wave (hereinafter may also be referred to as the continuous wave) instead of the burst wave, as the drive signal. Here, the reason why the basis-weight nonuniformity can be detected with the continuous wave as with the burst wave will be described. As described above, in a case where the continuous wave is used as the drive signal, the reception level is affected by the disturbance caused by the neighboring member. However, under a condition with the stabilized influence of the disturbance, the influence of the nonuniformity of the recording material P is dominant in a change in the reception level, and thus the basis-weight nonuniformity can be detected based on a change in the reception level.

Figure 6:
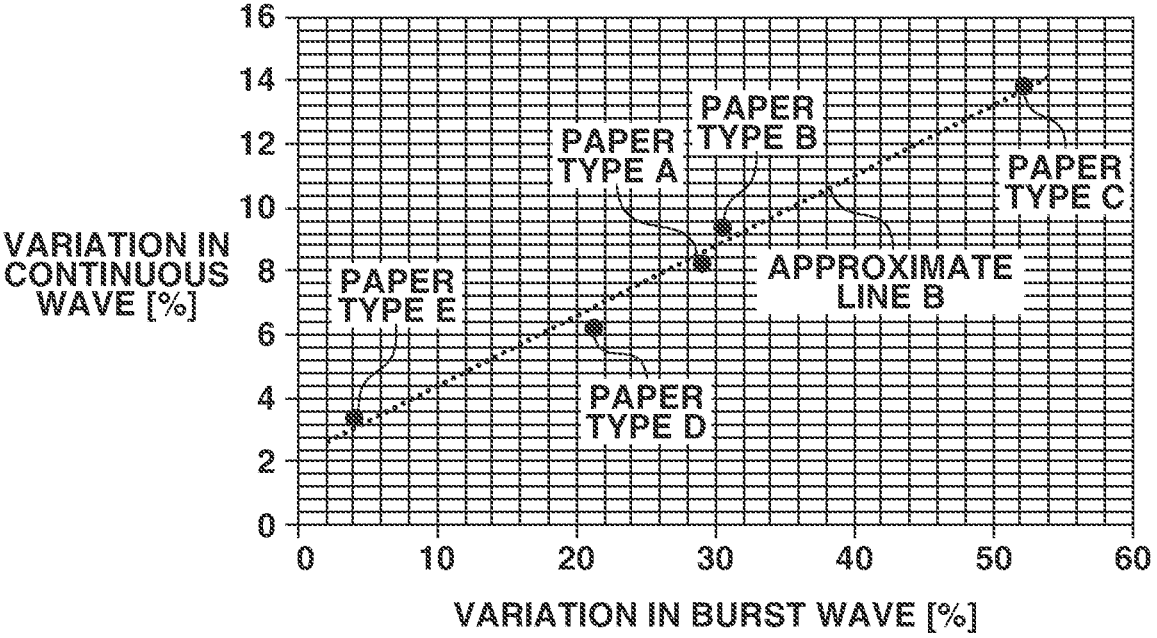
FIG. 6 is a graph illustrating the result of measuring variation in reception signal in each of a case where a burst wave is used as the drive signal and a case where a continuous wave is used as the drive signal, using each paper type.

FIG. 6 is a graph illustrating the result of measuring variation in reception signal in each of a case where the burst wave is used as the drive signal and a case where the continuous wave is used as the drive signal, using each paper type. The variation is calculated by calculating the dispersion and the mean value from the extracted plurality of reception levels, and dividing the dispersion by the mean value. There is a positive correlation between the variation in a case where calculation is performed using the drive signal in the form of the continuous wave and the variation in a case where calculation is performed using the drive signal in the form of the burst wave, as illustrated in FIG. 6. Therefore, in the case where the continuous wave is used as the drive signal, a characteristic value indicating the variation in the basis weight can be detected, as with the burst wave. Using an approximate line B in FIG. 6, the characteristic value indicating the variation in the basis weight in the case where the ultrasonic wave is transmitted in the form of the burst wave can be calculated from the characteristic value indicating the variation in the basis weight in the case where the ultrasonic wave is transmitted in the form of the continuous wave.

Figure 7:
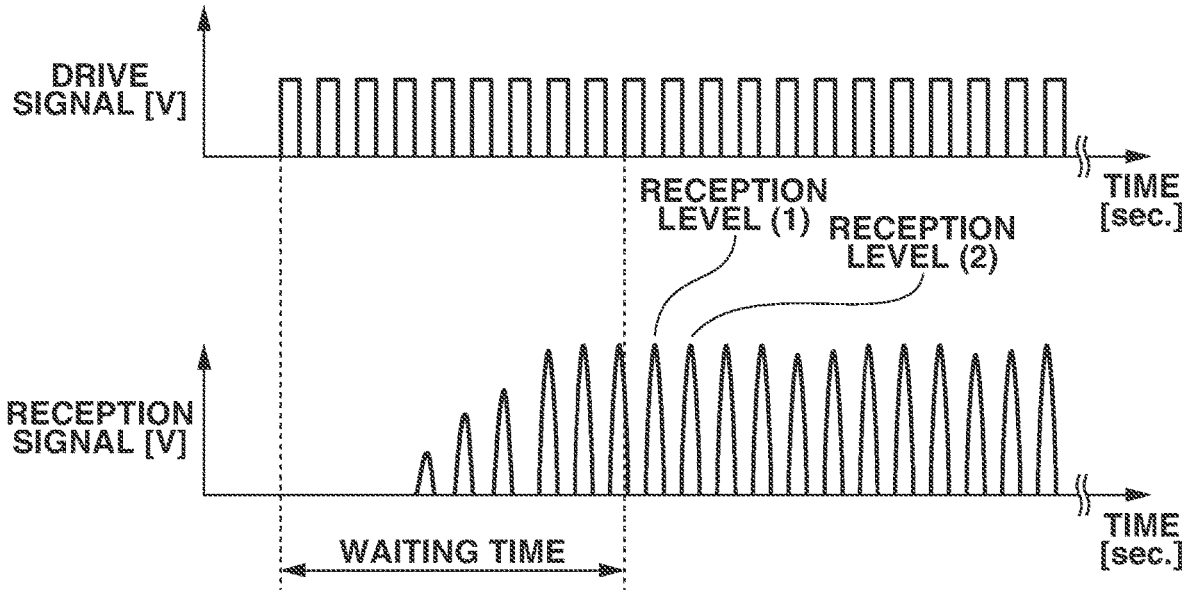
FIG. 7 is a diagram illustrating the drive signal and the reception signal of the ultrasonic wave in a case where basis-weight nonuniformity of the recording material P is detected.

FIG. 7 is a diagram illustrating the drive signal and reception signal of the ultrasonic wave in a case where the basis-weight nonuniformity of the recording material P is detected. A summary of operation for calculating the change rate of the basis weight of the recording material P, serving as a second mode, will be described with reference to FIG. 7. The detailed description of a part similar to that of the operation summary described above with reference to FIG. 3 in the case where the mean value of the basis weight of the recording material P is detected will be omitted. The control unit 10 transmits the drive signal of the continuous pulse wave (the continuous wave) to the transmission control unit 42. In other words, the control unit 10 can be said to transmit the drive signal of a second number (9 pulses) greater than the first number in a predetermined period (10 msec). In the predetermined period, the control unit 10 performs continuous driving of continuously outputting the drive signal.

The control unit 10 transmits the drive signal to the transmission control unit 42 in a period in which the recording material P is conveyed between the transmission unit 31*a* and the reception unit 31*b*. Subsequently, a reception level (1), a reception level (2), . . . , and a reception level (n) of the received ultrasonic wave through the recording material P while the recording material P is conveyed are sequentially extracted. These reception levels can also be referred to as the second value.

To extract the reception level under a condition with the stabilized influence of the disturbance caused by the recording material P and the neighboring member, the extraction of the reception level starts after a fixed waiting time has elapsed subsequent to the start of a rise of the drive signal. The control unit 10 calculates the dispersion and the mean value from the extracted plurality of reception levels, and a value obtained by dividing the dispersion by the mean value is determined as a characteristic value (hereinafter may also be referred to as the change rate) relating to the basis-weight nonuniformity of the recording material P. The calculation of the change rate in the present exemplary embodiment uses the dispersion, but is not limited thereto. For example, a characteristic value that changes depending on the basis-weight nonuniformity of the recording material P, such as a peak-to-peak (PP) value that is the difference between the maximum value and the minimum value, a cycle, or a slope, can be used as a substitute. Further, the combination of some of these characteristic values may be used.

The continuous wave is thus used as the drive signal, so that the resolving power is improved and the characteristic value of the basis-weight nonuniformity of the recording material P can be detected. This makes it possible to determine the variation in the basis weight more accurately. For example, in a case where the conveyance speed for the recording material P is 300 mm/sec, the minimum resolving power for detecting the basis-weight nonuniformity is 7.5 μm, and therefore, using the continuous wave enables the basis-weight nonuniformity to be measured with the high resolving power.

Figure 8:
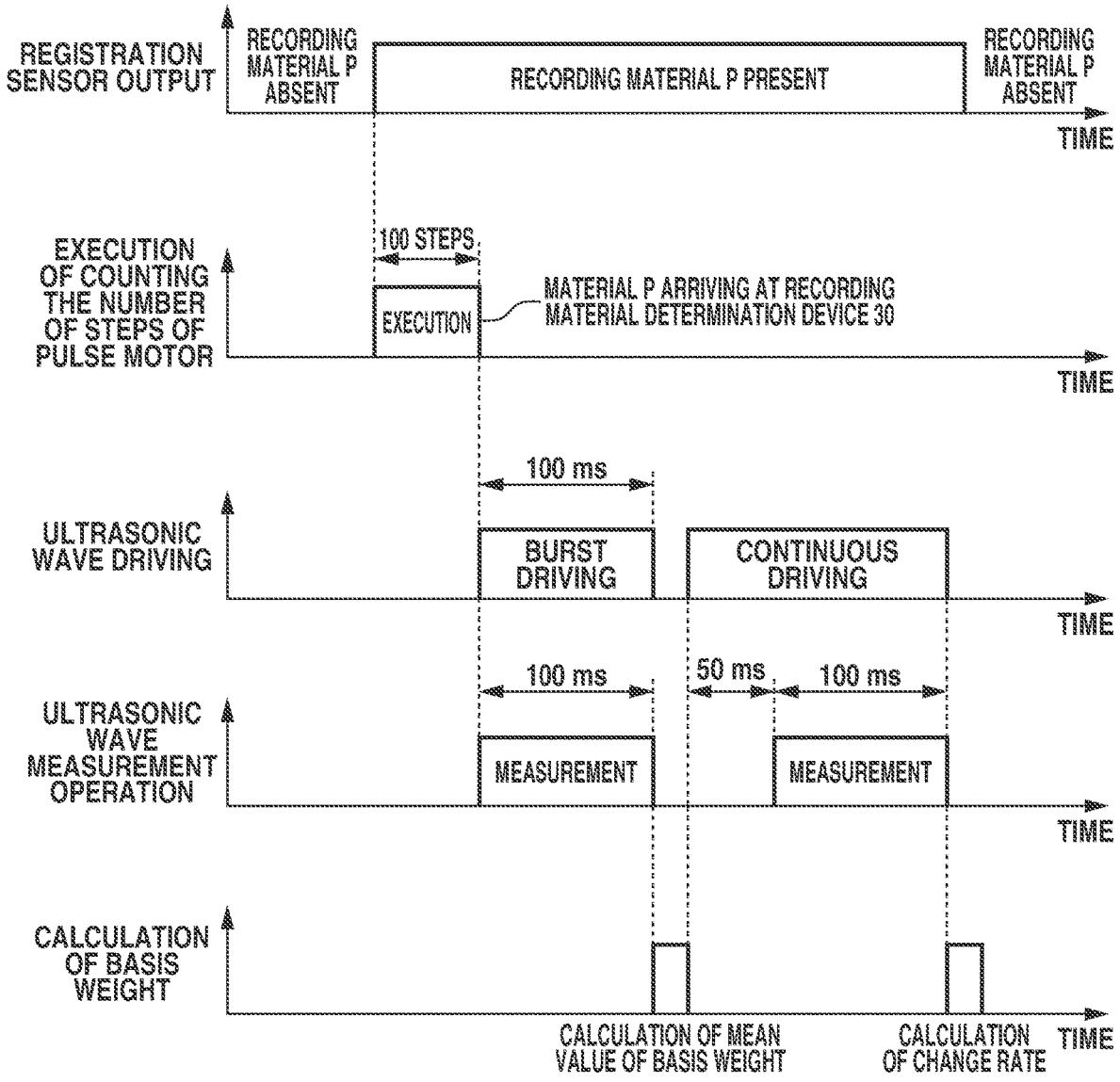
FIG. 8 is a timing chart illustrating the calculation of the mean value of the basis weight of the recording material P based on the ultrasonic wave transmitted in the form of the burst wave, followed by the calculation of the change rate of the basis weight of the recording material P based on the ultrasonic wave transmitted in the form of the continuous wave.

FIG. 8 is a timing chart illustrating the calculation of the mean value of the basis weight of the recording material P based on the ultrasonic wave transmitted in the form of the burst wave, followed by the calculation of the change rate of the basis weight of the recording material P based on the ultrasonic wave transmitted in the form of the continuous wave. First, a method of predicting an arrival distance of the recording material P and an arrangement relationship in a conveyance system will be described. In the present exemplary embodiment, the control unit 10 predicts the arrival distance of the recording material P, based on information of the registration sensor 34, and a pulse motor (not illustrated) that is a drive source for supplying a driving force to members for conveying the recording material P such as the registration roller pair 6. There is a proportional relationship between the step count of the pulse motor and the rotation distance of the registration roller pair 6, and thus the travel distance of the recording material P after passing through the registration roller pair 6 can be predicted from the counted number of steps.

In the present exemplary embodiment, the step count before the recording material P arrives at the recording material determination device 30 from the position where the recording material P has passed through the registration roller pair 6 may be, desirably, 100 steps. 100 steps is only an example, and the step count can be calculated from the diameters of the pulse motor and the registration roller pair 6 being used and the calculated step count can be set. The motor is not limited to the pulse motor. Any motor is sufficient if it is possible to predict the arrival of the recording material P at the position of the recording material determination device 30. Therefore, it is also possible to predict the arrival of the recording material P at the timing when a predetermined time has elapsed since the timing of the arrival of the recording material P at the registration sensor 34.

In the timing chart in FIG. 8, at first, whether the recording material P has been conveyed to the registration sensor 34 is determined based on an output of the registration sensor 34. When the recording material P arrives at the registration sensor 34, the pulse motor is driven 100 steps, and the recording material P is conveyed to the detection area of the recording material determination device 30. When the recording material P arrives at the detection area of the recording material determination device 30, the ultrasonic wave is transmitted by burst driving in a period of 100 ms. The ultrasonic wave through the recording material P is received in the period of 100 ms. The mean value of the basis weight of the recording material P is calculated based on the reception level of the received ultrasonic wave.

After completion of the burst driving of the ultrasonic wave, the ultrasonic wave is transmitted by continuous driving in a period of 150 ms. Subsequently, the ultrasonic wave through the recording material P is received in a period of 100 ms after a lapse of 50 ms following the start of the continuous driving. The change rate of the basis weight of the recording material P is calculated based on the reception level of the received ultrasonic wave. The measurement period for each of the ultrasonic waves is 100 ms, but is not limited thereto. The measurement period can be appropriately set, depending on the installation environment of the image forming apparatus, the desired detection accuracy, or the like.

Figure 9:
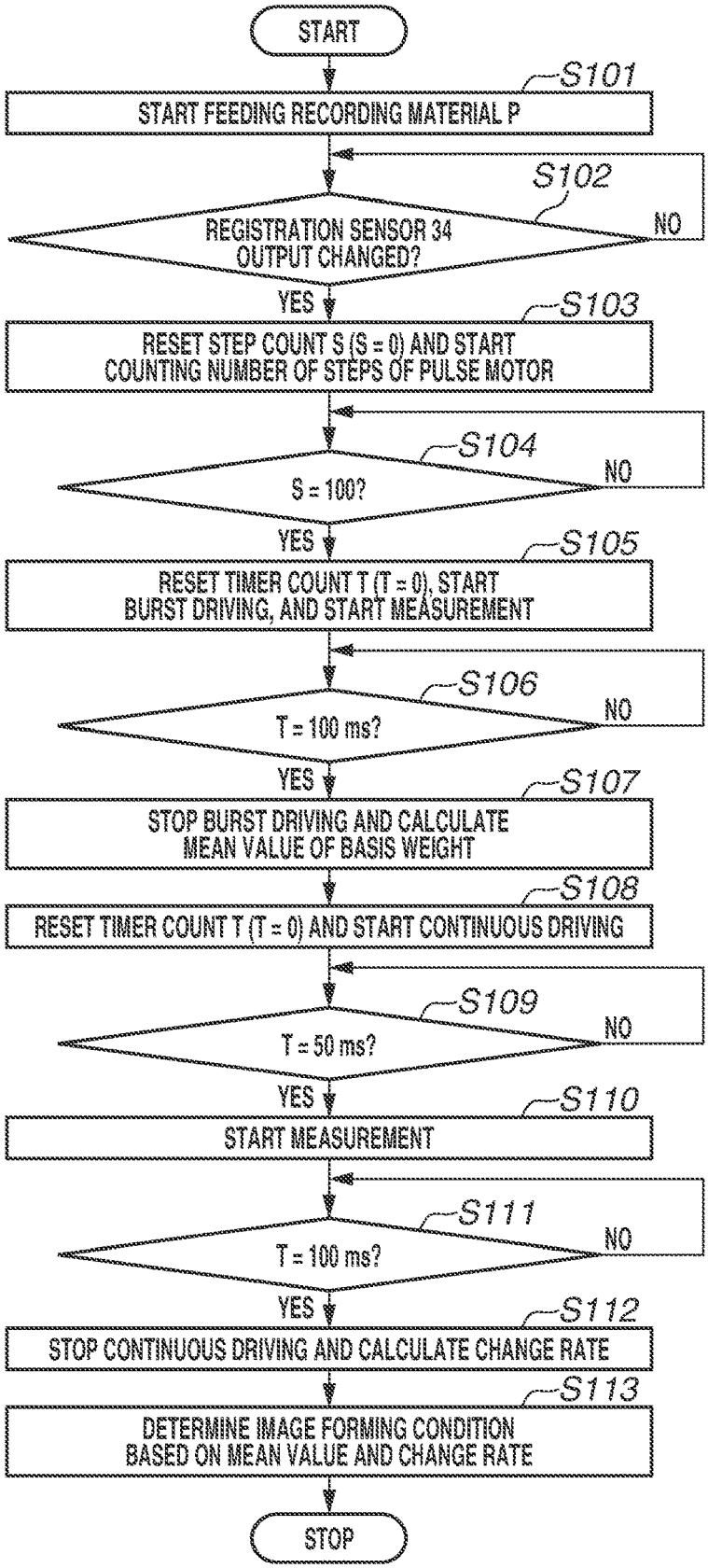
FIG. 9 is a flowchart illustrating the calculation of the mean value of the basis weight of the recording material P based on the ultrasonic wave transmitted in the form of the burst wave, followed by the calculation of the change rate of the basis weight of the recording material P based on the ultrasonic wave transmitted in the form of the continuous wave.

FIG. 9 is a flowchart illustrating the calculation of the mean value of the basis weight of the recording material P based on the ultrasonic wave transmitted in the form of the burst wave, followed by the calculation of the change rate of the basis weight of the recording material P based on the ultrasonic wave transmitted in the form of the continuous wave. In step S101, upon receiving a print instruction, the control unit 10 starts feeding the recording material P. In step S102, the control unit 10 determines whether the recording material P has been conveyed to the registration sensor 34. In other words, the control unit 10 determines whether the output value of the registration sensor 34 is changed from a HIGH signal to a LOW signal. Here, the configuration in which the HIGH signal is output in a state where the recording material P is not detected and the LOW signal is output in a state where the recording material P is detected is described as an example. However, the present exemplary embodiment is not limited thereto, and a configuration in which the LOW signal is output in a state where the recording material P is not detected and the HIGH signal is output in a state where the recording material P is detected may be adopted. If the recording material P is detected (YES in step S102), the operation proceeds to step S103.

In step S103, the control unit 10 resets a step count S. Subsequently, the control unit 10 starts counting the number of steps (the step count S) of the pulse motor, in response to the detection of the recording material P by the registration sensor 34. In step S104, the control unit 10 determines whether the step count S of the pulse motor is 100. If the step count S is 100 (YES in step S104), the operation proceeds to step S105.

In step S105, the control unit 10 determines that the recording material P has arrived at the detection area of the recording material determination device 30. Subsequently, the control unit 10 starts the measurement of the mean value of the basis weight of the recording material P. First, the control unit 10 resets a timer count T. Subsequently, the control unit 10 outputs the drive signal of the burst driving, so that the ultrasonic wave is transmitted. In step S106, the control unit 10 determines whether the timer count T is 100 ms. If the timer count T is 100 ms (YES in step S106), the operation proceeds to step S107. In step S107, the control unit 10 stops the drive signal of the burst driving. Subsequently, the control unit 10 calculates the mean value of the basis weight of the recording material P, based on the reception level of the ultrasonic wave through the recording material P.

In step S108, the control unit 10 starts the measurement of the change rate of the basis weight of the recording material P. First, the control unit 10 resets the timer count T. The control unit 10 then outputs the drive signal of the continuous driving, so that the ultrasonic wave is transmitted. In step S109, the control unit 10 determines whether the timer count T is 50 ms. If the timer count T is 50 ms (YES in step S109), the operation proceeds to step S110. In step S110, the control unit 10 starts the measurement of the ultrasonic wave through the recording material P. In step S111, the control unit 10 determines whether the timer count T is 100 ms further from 50 ms. The reception of the ultrasonic wave continues until 100 ms has elapsed, and if the timer count T is 100 ms (YES in step S111), the operation proceeds to step S112. In step S112, the control unit 10 stops the drive signal of the continuous driving. Subsequently, the control unit 10 calculates the change rate of the basis weight of the recording material P, based on the reception level of the ultrasonic wave through the recording material P.

In step S113, the control unit 10 determines the type of the recording material P, based on the mean value obtained in S107 and the change rate obtained in step S112. Subsequently, based on the determined type of the recording material P, the control unit 10 determines the image forming condition such as the secondary transfer condition or the fixing condition, and executes the image formation using the condition corresponding to the type of the recording material P. Here, the method of determining the type of the recording material P based on the mean value and the change rate is described as an example, but the present exemplary embodiment is not limited thereto. For example, instead of directly determining the type of the recording material P, the control unit 10 may determine the image forming condition such as the secondary transfer condition or the fixing condition from the mean value and the change rate, and execute the image formation using the determined image forming condition.

Here, the determination of the recording material P in a case where the mean value of the basis weight is 200 dec and the change rate of the basis weight is 9% will be described as an example in the present exemplary embodiment. First of all, the mean value of the basis weight is 200 dec, but the value of the basis weight can change to some extent depending on in which area of the recording material P the basis weight is detected. As illustrated in the graph in FIG. 4, the paper types B, C, and D are candidates for the type of the recording material P in which the mean value of the basis weight is 200 dec. Secondly, as illustrated in the graph in FIG. 6, because the change rate of the basis weight is 9%, the paper types A and B are candidates for the type of the recording material P in which the change rate of the basis weight is 9%. In view of the candidates derived from the mean value and the change rate, the type of the recording material P in this case can be determined to be the paper type B. In other words, even if the paper types are difficult to determine using only the mean values of the basis weights because the mean values are relatively close, the characteristic of the recording material P can be determined additionally using the change rate of the basis weight as a parameter, so that the type of the recording material P can be accurately determined.

In this way, the mean value of the basis weight of the recording material P is calculated using the burst wave for the drive signal, and the change rate of the basis weight of the recording material P is calculated using the continuous wave for the drive signal. The type of the recording material P is then determined using the mean value and the change rate of the basis weight. Therefore, the type of the recording material P that is a type difficult to accurately determine in a case where only the mean value of the basis weight is used can also be accurately determined using the mean value and the change rate of the basis weight.

In the first exemplary embodiment, there is described the method of calculating the mean value of the basis weight upon the transmission of the ultrasonic wave by the output of the drive signal of the burst driving, and subsequently calculating the change rate of the basis weight upon the transmission of the ultrasonic wave by the output of the drive signal of the continuous driving. In a second exemplary embodiment, there will be described a method of calculating the change rate of the basis weight upon the transmission of the ultrasonic wave by the output of the drive signal of the continuous driving, and subsequently calculating the mean value of the basis weight upon the transmission of the ultrasonic wave by the output of the drive signal of the burst driving. The detailed description of configurations similar to those of the first exemplary embodiment including the image forming apparatus will be omitted in the present exemplary embodiment.

Figure 10:
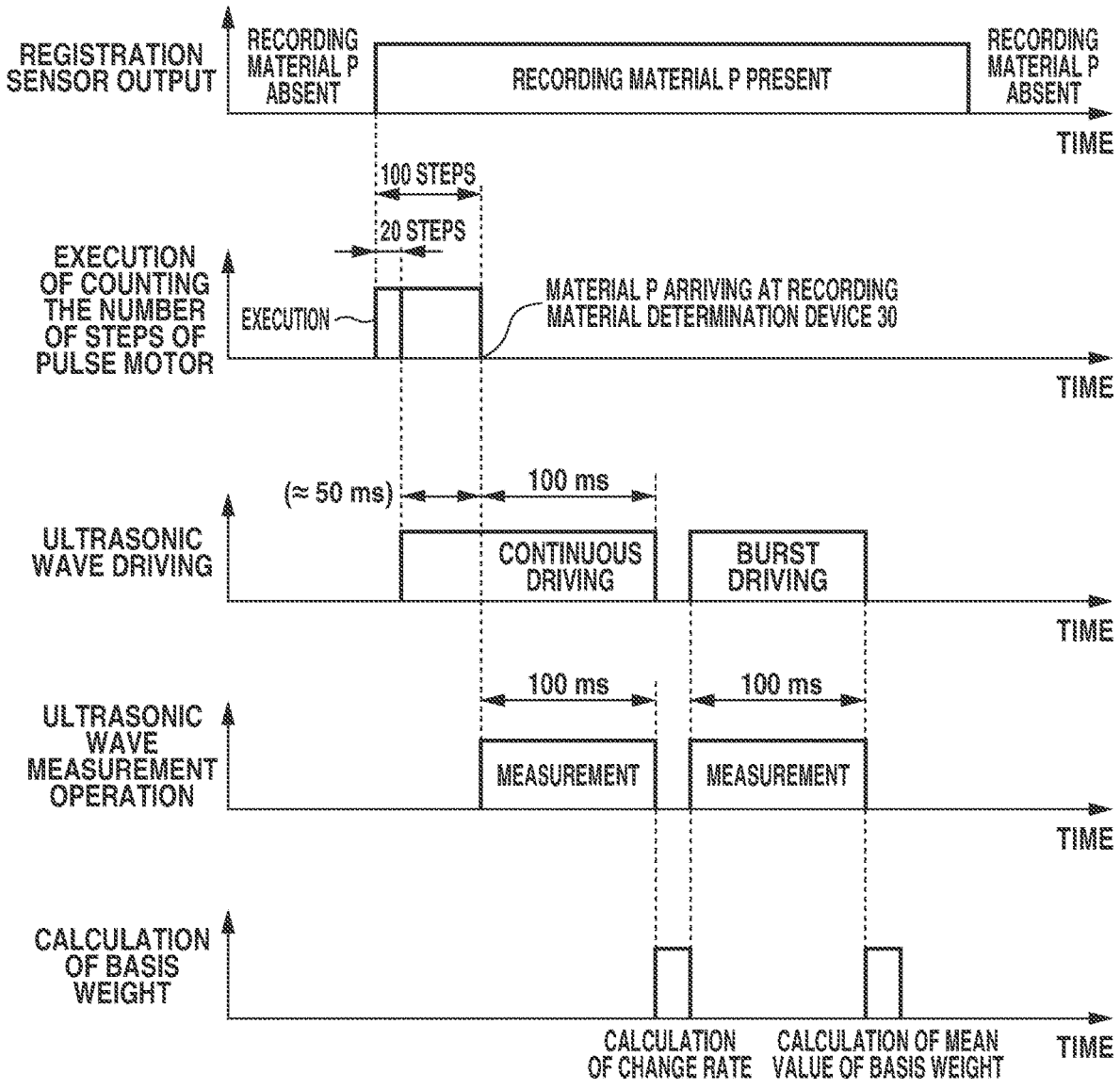
FIG. 10 is a timing chart illustrating the calculation of the change rate of the basis weight of the recording material P based on the ultrasonic wave transmitted in the form of the continuous wave, followed by the calculation of the mean value of the basis weight of the recording material P based on the ultrasonic wave transmitted in the form of the burst wave.

FIG. 10 is a timing chart illustrating the calculation of the change rate of the basis weight of the recording material P based on the ultrasonic wave transmitted in the form of the continuous wave, followed by the calculation of the mean value of the basis weight of the recording material P based on the ultrasonic wave transmitted in the form of the burst wave. In the timing chart in FIG. 10, at first, whether the recording material P has been conveyed to the registration sensor 34 is determined based on the output of the registration sensor 34. When the recording material P arrives at the registration sensor 34, the pulse motor is driven 100 steps, and the recording material P is conveyed to the detection area of the recording material determination device 30.

In the present exemplary embodiment, the ultrasonic wave is transmitted by the continuous driving, 80 steps before the recording material P arrives at the detection area of the recording material determination device 30. This because the waiting time of 50 ms starting from the timing of outputting the drive signal may be needed for the timing of starting the measurement in the continuous driving. Therefore, the output of the drive signal starts 50 ms earlier than the timing when the recording material P arrives at the detection area of the recording material determination device 30, so that the measurement of the reception signal of the ultrasonic wave can start as soon as the recording material P arrives at the detection area of the recording material determination device 30. The relationship between the step count and the time width can be determined from the conveyance amount of the recording material P and the conveyance speed for the recording material P per step. In the present exemplary embodiment, the time width of 50 ms can be determined as 80 steps.

When the recording material P arrives at the detection area of the recording material determination device 30, the ultrasonic wave through the recording material P is received in a period of 100 ms. The change rate of the basis weight of the recording material P is calculated based on the reception level of the received ultrasonic wave.

After completion of the continuous driving of the ultrasonic wave, the ultrasonic wave is transmitted by the burst driving in a period of 100 ms. The ultrasonic wave through the recording material P is received in the period of 100 ms. The mean value of the basis weight of the recording material P is calculated based on the reception level of the received ultrasonic wave. The measurement period for each of the ultrasonic waves is 100 ms, but is not limited thereto. The measurement period can be appropriately set, depending on the installation environment of the image forming apparatus, the desired detection accuracy, or the like.

Figure 11:
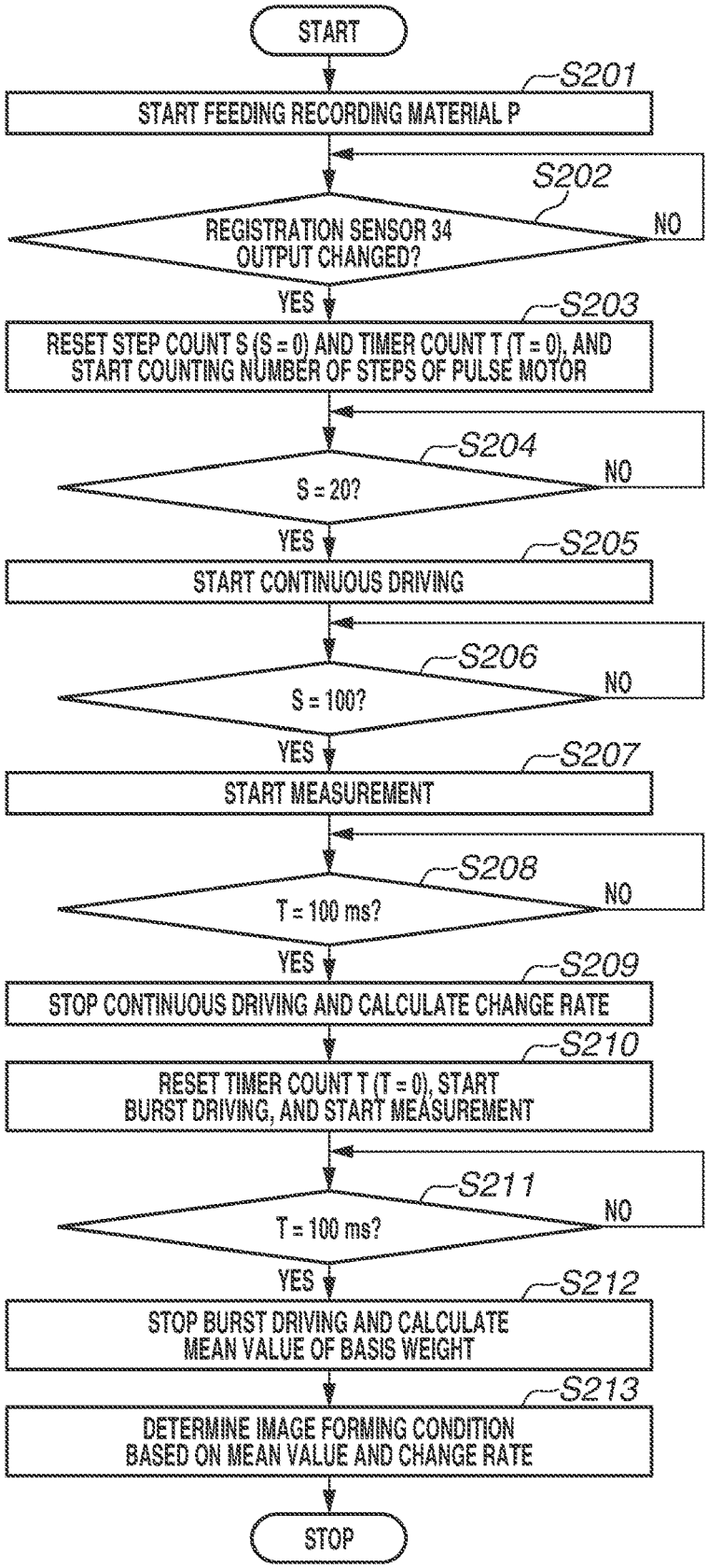
FIG. 11 is a flowchart illustrating the calculation of the change rate of the basis weight of the recording material P based on the ultrasonic wave transmitted in the form of the continuous wave, followed by the calculation of the mean value of the basis weight of the recording material P based on the ultrasonic wave transmitted in the form of the burst wave.

FIG. 11 is a flowchart illustrating the calculation of the change rate of the basis weight of the recording material P based on the ultrasonic wave transmitted in the form of the continuous wave, followed by the calculation of the mean value of the basis weight of the recording material P based on the ultrasonic wave transmitted in the form of the burst wave. In step S201, upon receiving a print instruction, the control unit 10 starts feeding the recording material P. In step S202, the control unit 10 determines whether the recording material P has been conveyed to the registration sensor 34. In other words, the control unit 10 determines whether the output value of the registration sensor 34 is changed from the HIGH signal to the LOW signal. Here, the configuration in which the HIGH signal is output in a state where the recording material P is not detected and the LOW signal is output in a state where the recording material P is detected is described as an example. However, the present exemplary embodiment is not limited thereto. A configuration in which the LOW signal is output in a state where the recording material P is not detected and the HIGH signal is output in a state where the recording material P is detected may be adopted. If the recording material P is detected (YES in step S202), the operation proceeds to step S203.

In step S203, the control unit 10 resets the step count S and the timer count T. Subsequently, the control unit 10 starts counting the number of steps (the step count S) of the pulse motor, in response to the detection of the recording material P by the registration sensor 34. In step S204, the control unit 10 determines whether the step count S of the pulse motor is 20. If the step count S is 20 (YES in step S204), the operation proceeds to step S205.

In step S205, the control unit 10 outputs the drive signal of the continuous driving, so that the ultrasonic wave is transmitted. In step S206, the control unit 10 determines whether the step count S of the pulse motor is 100. If the step count S is 100 (YES in step S206), the operation proceeds to step S207. In step S207, the control unit 10 starts the measurement of the ultrasonic wave through the recording material P. In step S208, the control unit 10 determines whether the timer count T is 100 ms. If the timer count T is 100 ms (YES in step S208), the operation proceeds to step S209. In step S209, the control unit 10 stops the drive signal of the continuous driving. Subsequently, the control unit 10 calculates the change rate of the basis weight of the recording material P, based on the reception level of the ultrasonic wave through the recording material P.

In step S210, the control unit 10 starts the measurement of the mean value of the basis weight of the recording material P. First, the control unit 10 resets the timer count T. The control unit 10 then outputs the drive signal of the burst driving, so that the ultrasonic wave is transmitted. In step S211, the control unit 10 determines whether the timer count T is 100 ms. If the timer count T is 100 ms (YES in step S211), the operation proceeds to step S212. In step S212, the control unit 10 stops the drive signal of the burst driving. Subsequently, the control unit 10 calculates the mean value of the basis weight of the recording material P, based on the reception level of the ultrasonic wave through the recording material P.

In step S213, the control unit 10 determines the type of the recording material P, based on the change rate obtained in step S209 and the mean value obtained in step S212. Subsequently, based on the determined type of the recording material P, the control unit 10 determines the image forming condition such as the secondary transfer condition or the fixing condition, and executes the image formation using the condition corresponding to the type of the recording material P. Here, the method of determining the type of the recording material P based on the mean value and the change rate is described as an example, but the present exemplary embodiment is not limited thereto. For example, instead of directly determining the type of the recording material P, the control unit 10 may determine the image forming condition such as the secondary transfer condition or the fixing condition from the mean value and the change rate, and execute the image formation using the determined image forming condition.

In this way, the mean value of the basis weight of the recording material P is calculated using the burst wave for the drive signal, and the change rate of the basis weight of the recording material P is calculated using the continuous wave for the drive signal. Subsequently, the type of the recording material P is determined using the mean value and the change rate of the basis weight. Therefore, the type of the recording material P that is a type difficult to accurately determine in a case where only the mean value of the basis weight is used can also be accurately determined using the mean value and the change rate of the basis weight. Further, the output of the drive signal of the continuous driving starts before the recording material P arrives at the detection area of the recording material determination device 30, so that the time period for determining the recording material P can be reduced.

According to the configurations of the present exemplary embodiments, a decrease in the accuracy of detecting the recording material can be prevented.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-109835, filed Jun. 25, 2020, which is hereby incorporated by reference herein in its entirety.

What is claimed is:

1. A recording material determination device comprising:

a transmission unit configured to transmit an ultrasonic wave;

a drive unit configured to output a drive signal for transmitting the ultrasonic wave from the transmission unit;

a reception unit configured to receive the ultrasonic wave; and a control unit configured to determine a type of a recording material, wherein the control unit determines the type of the recording material, based on a first value of the ultrasonic wave through the recording material received by the reception unit in a first mode for outputting a first number of drive signals from the drive unit in a first period, and a second value of the ultrasonic wave through the recording material received by the reception unit in a second mode for outputting a second number of drive signals from the drive unit in a second period, and wherein the second number of drive signals is greater than the first number of drive signals.

2. The recording material determination device according to claim 1, wherein the second mode is executed after the first mode is executed.

3. The recording material determination device according to claim 1, wherein the first mode is executed after the second mode is executed.

4. The recording material determination device according to claim 1, wherein the drive unit is configured to execute burst driving for the drive signal in the first mode and to execute continuous driving for the drive signal in the second mode.

5. The recording material determination device according to claim 1, wherein the drive unit is configured to execute intermittent driving of alternately repeating a period for transmitting the drive signal and a period for not transmitting the drive signal in the first mode, and is configured to execute continuous driving of continuously transmitting the drive signal in the second mode.

6. The recording material determination device according to claim 1, wherein the control unit is configured to calculate a value relating to a mean value of basis weight of the recording material based on the first value of the ultrasonic wave, is configured to calculate a value relating to a change rate of the basis weight of the recording material based on the second value of the ultrasonic wave, and is configured to determine the type of the recording material based on the value relating to the mean value and the value relating to the change rate.

7. An image forming apparatus comprising:

an image forming unit configured to form an image on a recording material;

a transmission unit configured to transmit an ultrasonic wave;

a drive unit configured to output a drive signal for transmitting the ultrasonic wave from the transmission unit;

a reception unit configured to receive the ultrasonic wave; and a control unit configured to control an image forming condition in the image forming unit, wherein the control unit controls the image forming condition, based on a first value of the ultrasonic wave through the recording material received by the reception unit in a first mode for outputting a first number of drive signals from the drive unit in a first period, and a second value of the ultrasonic wave through the recording material received by the reception unit in a second mode for outputting a second number of drive signals from the drive unit in a second period, and wherein the second number of drive signals is greater than the first number of drive signals.

8. The image forming apparatus according to claim 7, wherein the image forming unit includes a transfer unit configured to transfer the image to the recording material, and includes a fixing unit configured to fix the image to the recording material, and wherein the control unit is configured to control, as the image forming condition, a transfer bias to be applied to the transfer unit or a fixing temperature of the fixing unit.

9. The image forming apparatus according to claim 7, wherein the second mode is executed after the first mode is executed.

10. The image forming apparatus according to claim 7, wherein the first mode is executed after the second mode is executed.

11. The image forming apparatus according to claim 7, wherein the drive unit is configured to execute burst driving for the drive signal in the first mode and to execute continuous driving for the drive signal in the second mode.

12. The image forming apparatus according to claim 7, wherein the drive unit is configured to execute intermittent driving of alternately repeating a period for transmitting the drive signal and a period for not transmitting the drive signal in the first mode, and is configured to execute continuous driving of continuously transmitting the drive signal in the second mode.

13. The image forming apparatus according to claim 7, wherein the control unit is configured to calculate a value relating to a mean value of basis weight of the recording material based on the first value of the ultrasonic wave, is configured to calculate a value relating to a change rate of the basis weight of the recording material based on the second value of the ultrasonic wave, and is configured to determine the type of the recording material based on the value relating to the mean value and the value relating to the change rate.

14. A method for a recording material determination device, the method comprising:

transmitting an ultrasonic wave;

outputting a drive signal for transmitting the ultrasonic wave;

receiving the ultrasonic wave; and determining a type of a recording material, wherein determining includes determining the type of the recording material, based on a first value of the ultrasonic wave through the recording material received in a first mode for outputting a first number of drive signals in a first period, and a second value of the ultrasonic wave through the recording material received in a second mode for outputting a second number of drive signals in a second period, and wherein the second number of drive signals is greater than the first number of drive signals.

15. A non-transitory computer-readable storage medium storing a program to cause a computer to perform a method for a recording material determination device, the method comprising:

transmitting an ultrasonic wave;

outputting a drive signal for transmitting the ultrasonic wave;

receiving the ultrasonic wave; and determining a type of a recording material, wherein determining includes determining the type of the recording material, based on a first value of the ultrasonic wave through the recording material received in a first mode for outputting a first number of drive signals in a first period, and a second value of the ultrasonic wave through the recording material received in a second mode for outputting a second number of drive signals in a second period, and wherein the second number of drive signals is greater than the first number of drive signals.

* * * * *